US007597131B2

(12) United States Patent
Nien et al.

(10) Patent No.: US 7,597,131 B2
(45) Date of Patent: Oct. 6, 2009

(54) CORD LOCK APPARATUS OF WINDOW SHADE ASSEMBLY

(75) Inventors: Ming Nien, Lugang Township, Changhua County (TW); Yu-Che Wen, Gueishan Township, Taoyuan County (TW); Chih-Yao Chang, Taichung (TW); David Pon, Tustin, CA (US); Judkins Ren, Pittsburgh, PA (US)

(73) Assignee: Nien Made Enterprise Co., Ltd., Taichuang (TW)

( * ) Notice: Subject to any disclaimer, the term of this patent is extended or adjusted under 35 U.S.C. 154(b) by 308 days.

(21) Appl. No.: 11/703,192

(22) Filed: Feb. 7, 2007

(65) Prior Publication Data

US 2008/0185110 A1 Aug. 7, 2008

(51) Int. Cl.
*E06B 9/324* (2006.01)

(52) U.S. Cl. ..... 160/178.2; 160/178.1 R; 160/168.1 R; 160/173 R; 160/84.04; 160/84.05; 24/134 KA; 24/134 R; 24/134 KB; 24/134 L

(58) Field of Classification Search ..... 160/178.2, 160/178.1 R, 168.1 R, 173 R, 84.04, 84.05; 24/134 KA, 134 R, 134 KB, 134 I
See application file for complete search history.

(56) References Cited

U.S. PATENT DOCUMENTS 4,716,630 A * 1/1988 Skyba ..... 24/134 R
4,913,210 A 4/1990 Colson et al.
5,156,196 A * 10/1992 Corey et al. ..... 160/178.2
5,472,036 A * 12/1995 Judkins ..... 160/178.2
5,623,982 A * 4/1997 Okazaki ..... 160/178.2
5,709,258 A * 1/1998 Coccoluto ..... 160/168.1 R
7,117,920 B2 * 10/2006 Dekker et al. ..... 160/178.2
7,159,636 B2 * 1/2007 Liang ..... 160/115
7,159,638 B2 * 1/2007 Hsu ..... 160/178.2
7,174,943 B2 * 2/2007 Wang ..... 160/178.2
7,261,138 B2 * 8/2007 Judkins et al. ..... 160/178.2
2003/0173037 A1 * 9/2003 Liu ..... 160/178.2
2005/0056384 A1 * 3/2005 Dekker et al. ..... 160/178.2
2007/0044925 A1 * 3/2007 Huang ..... 160/178.2
2007/0102125 A1 * 5/2007 Nien et al. ..... 160/178.2
2008/0099162 A1 * 5/2008 Ayers ..... 160/178.2

* cited by examiner

*Primary Examiner*—Katherine W Mitchell
*Assistant Examiner*—Philip S Kwon
(74) *Attorney, Agent, or Firm*—Rabin & Berdo, P.C.

(57) ABSTRACT

A cord lock apparatus of a window shade is provided, which includes a base, a panel structure, and a cord gripping device. The base includes an adjustable portion allowing cords to pass through and a first-direction ascending opening is formed allowing the cords to be alternatively positioned. The panel structure having an insert plate and a second-direction ascending opening is provided allowing cords to pass through, when the cords are selectively positioned along the inclined surface, the panel structure is moved in a vertically upward or downward motion. The cord gripping device has an engaging block and a knurled roller, the engaging block is removably attached within the accommodation recess. The knurled roller is positioned near the top of the engaging block and a gap is formed therebetween, such that the knurled roller is frictionally locked with or released from the cords when the panel structure moves vertically downward or upward.

8 Claims, 8 Drawing Sheets

CORD LOCK APPARATUS OF WINDOW SHADE ASSEMBLY

BACKGROUND OF THE INVENTION

1. Field of Invention

The present invention relates to a cord lock apparatus for controlling the cords of a window shade, and particularly to a cord lock apparatus which is capable of altering the engaging gap space between the cords.

2. Related Art

Quite frequently, a cord lock apparatus of a window shade operated by a plurality of cords, such as a conventional blind or typically but not necessary a pleated shade, generally is mounted with a locking dog means. For example, U.S. Pat. No. 4,913,210 discloses a cord lock for window shades. FIG. 1 is a front perspective view of a cord lock in the prior art, and FIG. 2 is a sectional side view of FIG. 1. Referring to FIGS. 1 and 2, a base 12 is assembled on either one side of a generally U-shaped top rail 11 of a window shade 10, and at least two or a plurality of cords 13 pass through the base 12 from the lower portion and thence over an engagement mechanism 14. Then, the cords 13 are guided to an exit on top of the base 12, and from there enter the U-shaped top rail 11. Then, the cords 13 exit from the U-shaped top rail 11 to suspend a plurality of shade member 15 and a bottom rail 16. The engagement mechanism 14 uses two stopping members to relatively adjust the gap space therebetween, permitting the cords 13 to pass through. That is, the cords 13 are angularly tilted to a predetermined position, such that the engaging members are relatively forced to rotate to a selective angle, and then the cords are released. Moreover, the cords 13 still are further drawn to an alternative angle, the stopping members are subsequently reoriented by the cords 13 to move to another position so as to lockly engage the cords 13 in place, thereby locking the shade member 15 and the bottom rail 16 to a desirably raised or lowered position.

The way for the engagement mechanism 14 to lock the cords 13 in place is to generate a friction force by alternatively modifying the angle of the stopping members to angularly turn the cords 13 therebetween, and basically the shade member 15 are retained into a fixed position through a "point contact" friction in nature. Therefore, the overall weight of the shade member 15 is completely imposed on this contact point thereon the cords 13, hence the durability of the engaging cords are considerably less in strength. Moreover, though the engagement mechanism 14 can desirably achieve the locking and releasing effect interfering with the cords 13, the gap therebetween the stopping members of the engagement mechanism 14 cannot be adjusted accordingly, so one single specifications of the engagement mechanism 14 can only practically accommodate with limited cords diameters. When the weight or the thickness of the shade member changes substantially, the cords in alternative diameter are required accordingly and the entire engagement mechanism 14 has to be replaced altogether. And thus, the manufacturers must produce engagement mechanisms 14 in a variety of specifications to properly accommodate the varying cords diameters in usage and so that the object of modular design on parts of the window shade cannot be fully achieved. In addition, the consumers or window shade installers must carefully distinguish and select appropriate specifications of the engagement mechanism to prevent inaccuracies in assembly.

SUMMARY OF THE INVENTION

Accordingly, a technical problem to be resolved by the present invention is to provide a cord lock apparatus of a window shade, which is capable of locking the cords at multiple contact points, so as to eliminate the worn out possibility of the engaging cords, and further to provide a cord lock apparatus of a window shade applicable for cords in varying diameters to pass through, without changing the original apparatus when the engaging cords are replaced into varying diameters. Another technical problem to be resolved by the present invention is to provide a window shade, which is effortlessly operated and capable of accommodating with varying cords diameters.

In order to resolve the aforementioned technical problems of the cord lock apparatus, the cord lock apparatus of the present invention comprises a base, a panel structure, and a cord gripping device. The base has an adjustable portion, a guide post, and a cord separating member positioned subsequently allowing cords to pass through. The adjustable portion has a first-direction ascending opening, a slot, and an accommodation recess, allowing the cords to slide in a relative position along the oblique surface. The panel structure has an insert plate wherein a second-direction ascending opening is disposed thereon. One end of the insert plate has an extension tongue extending frontwardly, and the other end is inserted into the slot. The cord gripping device has an engaging block and a knurled roller. The engaging block is removably attached within the accommodation recess. The knurled roller has a notched portion, an axial hole, and a groove allowing the extension tongue to be inserted therein. The knurled roller is pivotally disposed above the engaging block within the accommodation recess. Thus, two or a number of cords can enter from the first-direction ascending opening, pass through the second-direction ascending opening of the panel structure, and still further pass through the gap between the engaging block and the notched portion and then pass along the guide post, such that they are reoriented by the cord separating member and eventually enter into the top rail. When the cords pass therebetween the knurled roller and the engaging block, the panel structure subsequently moves in a vertical upward or downward movement, which will relatively affect the knurled roller rotating axially to the axial hole and thus lockly grip or release the cords therebetween.

If the control cords have to be rearranged in alternate diameter, it can replace the engaging block with appropriate thickness accordingly, therefore the gap between the engaging block and the notched portion is substantially changed and thus being applicable for cords with a greater or smaller diameter.

It is preferred that the present invention further includes a cord arrangement block along the cord passing path. The cord arrangement block has an oblique surface, such that one end of the cord which bearing the overall weight of the shade member can be made to distributed horizontally and subsequently enter to the top rail vertically.

It is further preferred that the present invention further includes a rotatable moving bush, which is sleeved on the guide post to permit the cords to pass along. Moreover, the guide post further comprises an end cap preventing the cords from dropping off from the guide post.

In order to resolve the aforementioned technical problems of a window shade, the present invention applies the knurled roller-type cord lock apparatus, so as to accommodate the different size of cords.

The advantage of the present invention lies in that, both of the knurled roller and the engaging block are removable, which can ease the cords installation. Besides, it is simple to replace the engaging block size, and the cords in alternate diameters can be lockly gripped therein. Also, the modular components provide the flexibility and variety in use and the capability for mass production required in the commercial environment. Moreover, when adjusting the cords, the friction force imposed against the guide post where the cords are passed over can be substantially minimised through the utilization of the sliding bush structure, so the user can apply considerably less force to adjust the shade member, and further enhance the operative performance of the control cords.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, which thus is not limited to the present invention, and wherein.

DETAILED DESCRIPTION OF THE INVENTION

The present invention is illustrated below more specifically with reference to the accompanying drawings and the embodiments.

Figure 1:
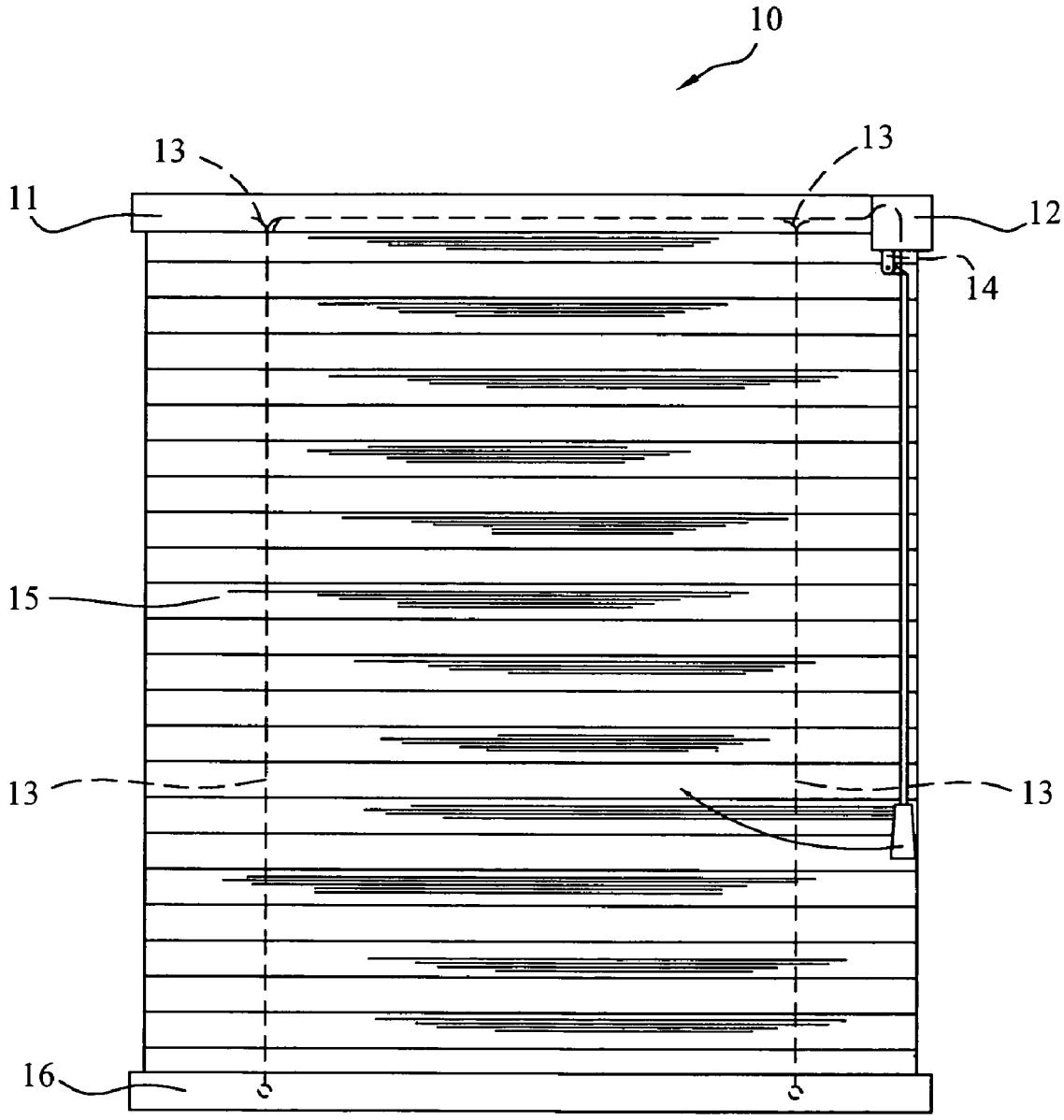
FIG.1 (PRIOR ART)
FIG. 1 is an overall front view of a cord lock for window shades in the prior art.
Figure 2:
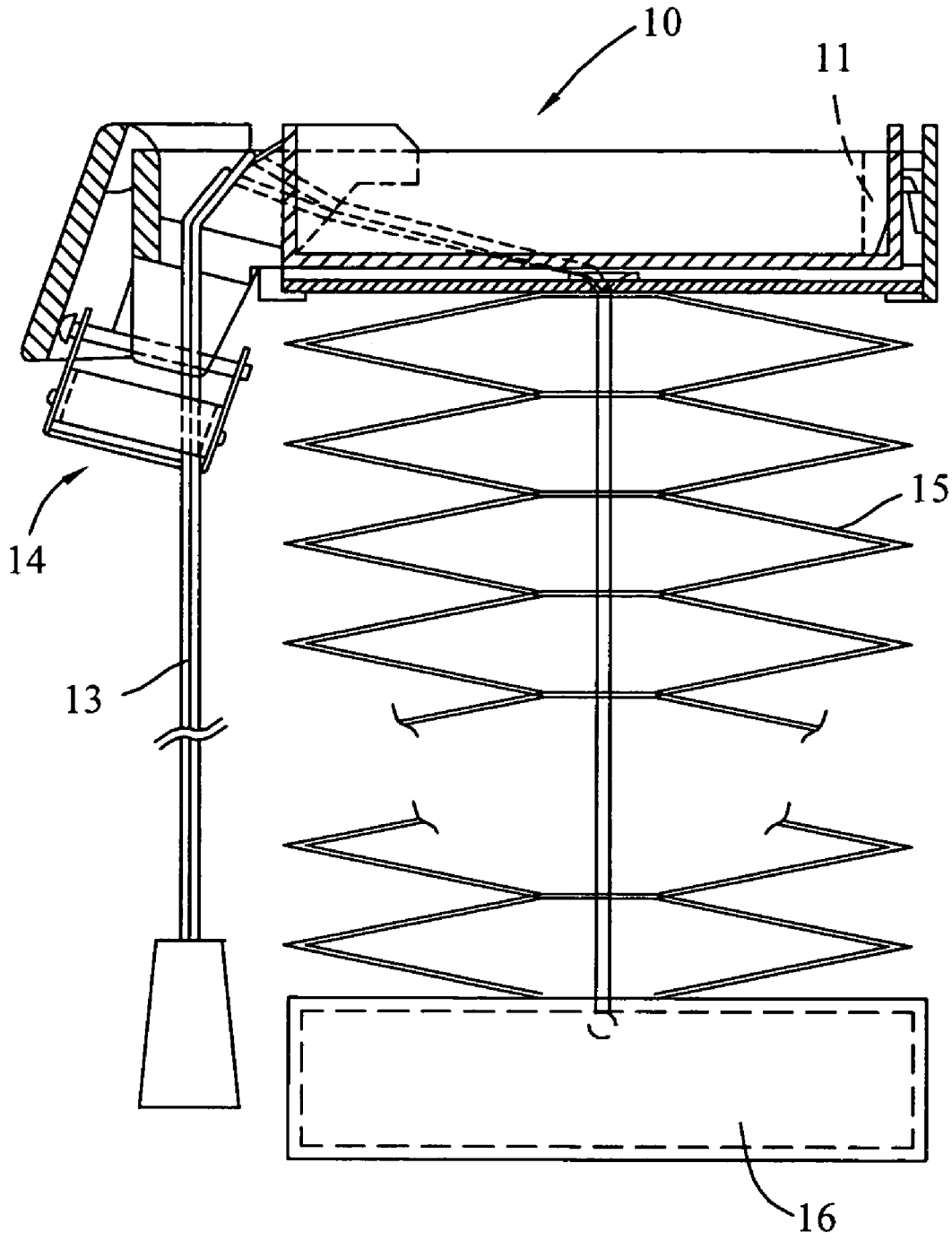
FIG.2 (PRIOR ART)
FIG. 2 is a cross sectional view of FIG. 1.
Figure 3:
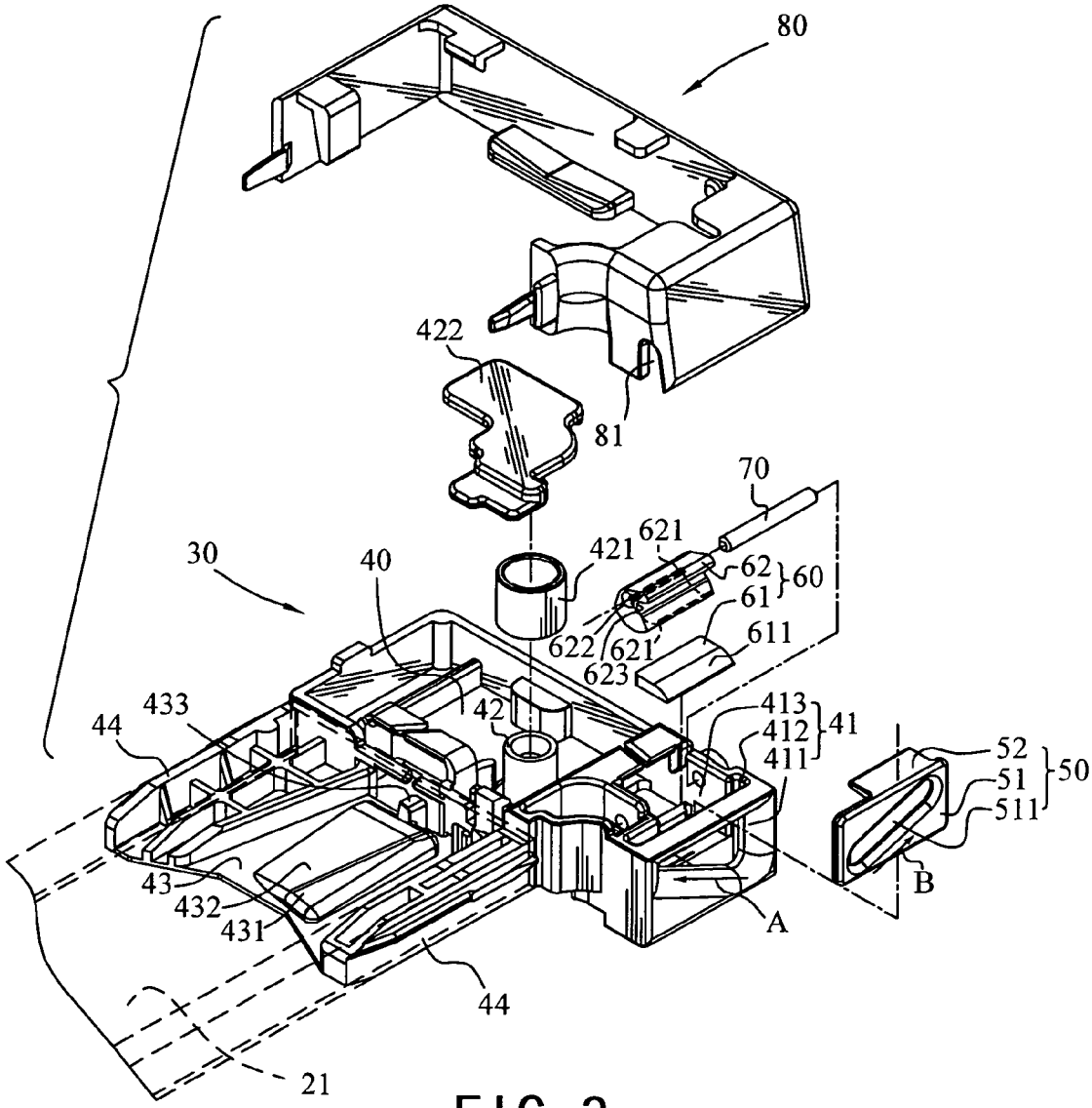
FIG. 3 is an exploded view of a cord lock apparatus in accordance with the present invention.
Figure 4:
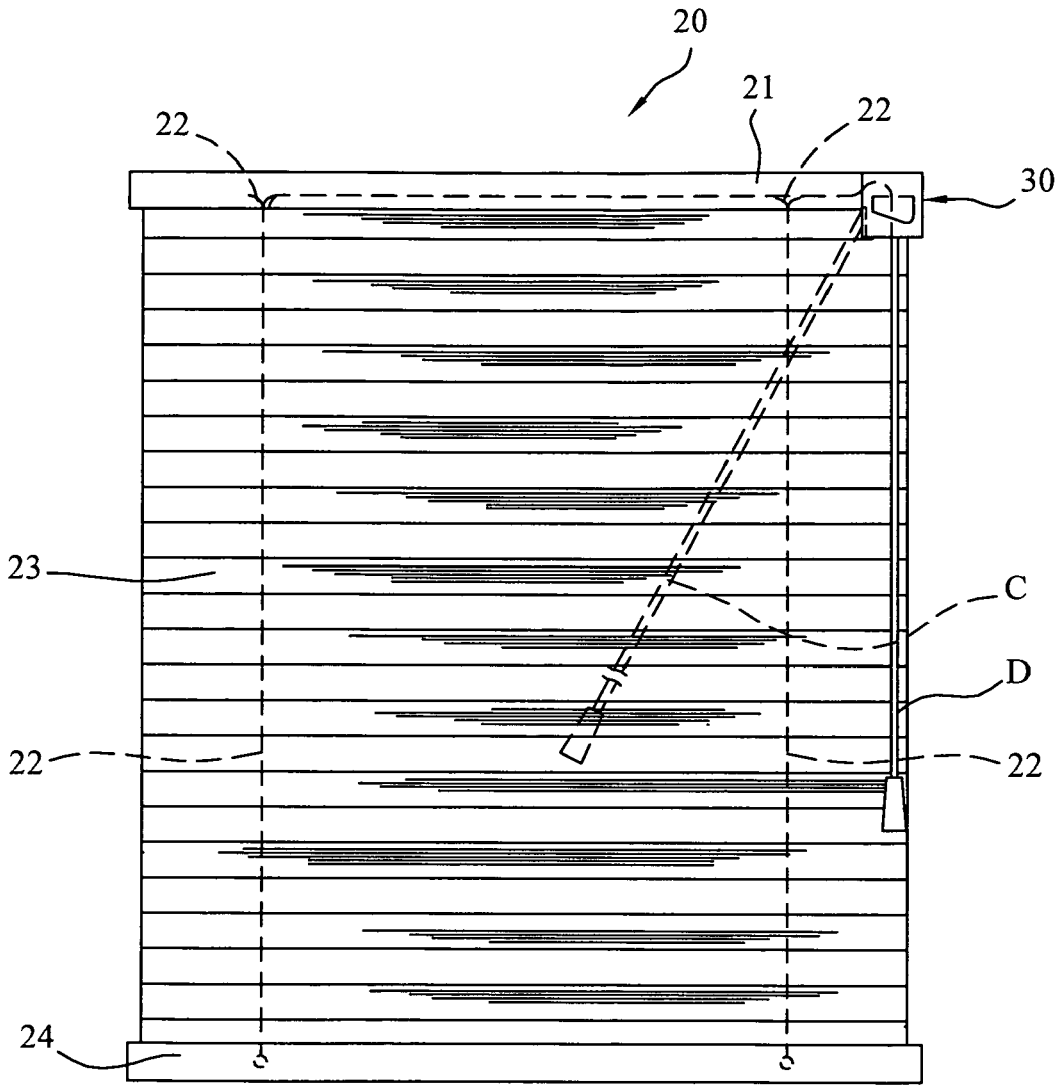
FIG. 4 is a schematic view illustrating a lock position and a release position of the control cords of a window shade in accordance with the present invention.
Figure 5:
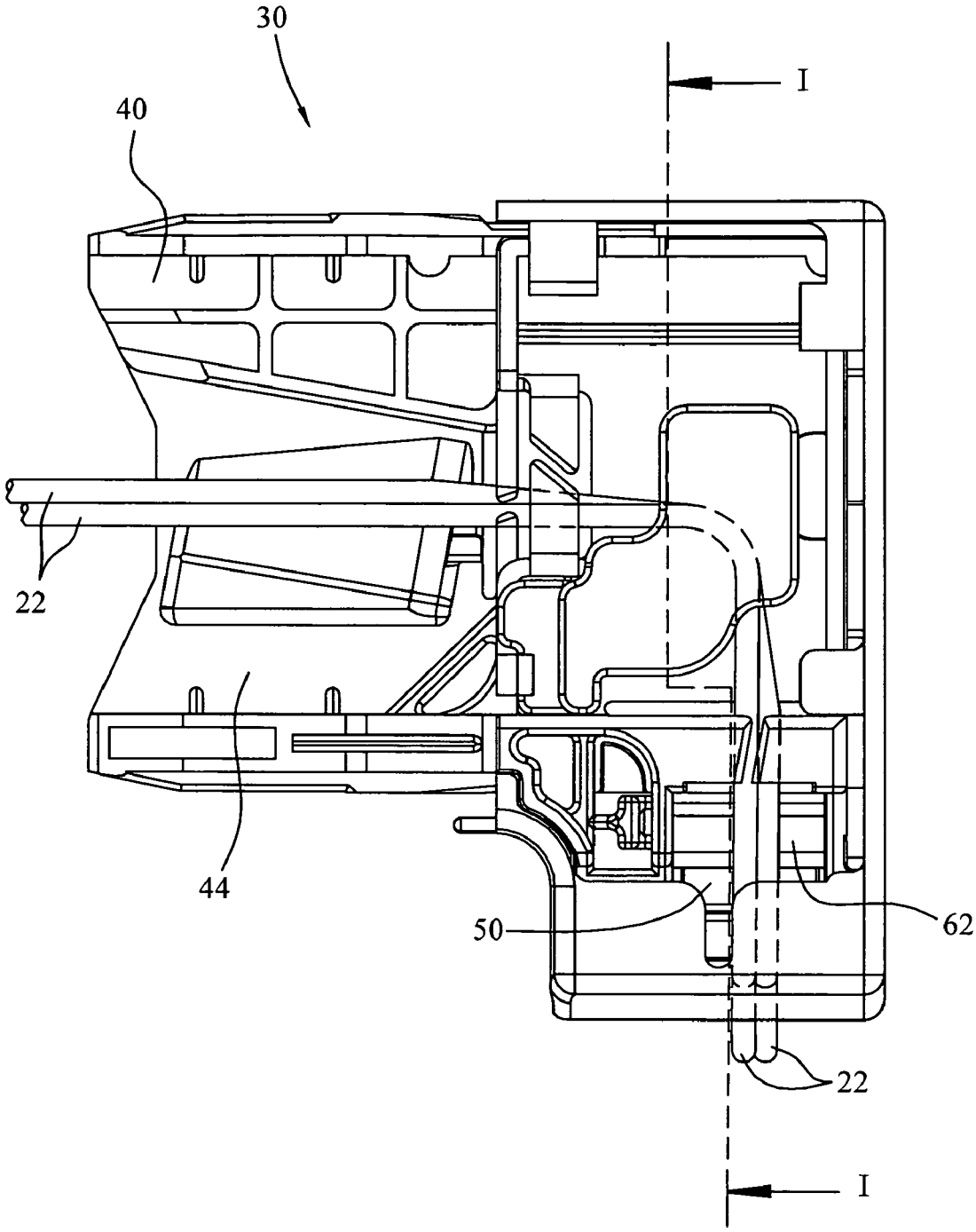
FIG. 5 is a schematic top plan view of the cord lock apparatus in accordance with the present invention.

FIG. 3 is an exploded view of a cord lock apparatus in accordance with the present invention, FIG. 4 is a perspective front view of a window shade with the cords shown in the engaged and unlocked (dotted lines) positions in accordance with the present invention, and FIG. 5 is a schematic top plan view of the cord lock apparatus in accordance with the present invention. The cord lock apparatus 30 includes a base 40, a panel structure 50 and a cord gripping device 60. The panel structure 50 and the cord gripping device 60 are assembled on the base 40. The base 40 has an adjustable portion 41, a guide post 42, and a cord separating member 43. The cord separating member 43 is positioned relative to the adjustable portion 41 such that a turning angle is formed by the cord separating member 43 and the adjustable portion 41 with respect to the guide post 42. A first-direction ascending opening 411, a slot 412 and an accommodation recess 413 are integrally formed extending from the outermost portion of the base 40. The first-direction ascending opening 411 faces the same orientation as of first direction A. The slot 412 is disposed perpendicularly to the cords entering direction. The panel structure 50 includes an insert plate 51 having a second-direction ascending opening 511 as of the second direction B facing in an opposite direction to the first direction A (the opening is given as of oval-shaped aperture in this embodiment, however, numerous modifications may be made to the shape according to the present invention as long as a pair of inclined apertures oriented in the opposite orientation to one another as of described hereinafter the contact surface I and H). One end of the insert plate 51 extending outwardly from the upper margin to form an extension tongue and the other end of the insert plate 51 is removably inserted into the slot 412. The cord gripping device 60 includes an engaging block 61 and a knurled roller 62. The engaging block 61 is removably attached within the accommodation recess 413. The engaging block 61 has an arch-like front surface 611 facing toward the panel structure so as to evenly and uniformly dispose the receiving cords 22 thereon, assuring the subsequent gripping effect in full. The knurled roller 62 has a notched portion 621, an axial hole 622 passing longitudinally through the knurled roller 62, and a groove 623 allowing the extension tongued 52 to be inserted therein. The knurled roller 62 is pivotally positioned above the engaging block 61 within the accommodation recess 413 by a shaft 70 passing through the axial hole 622, whereby the knurled roller 62 rotates axially with respect to the axial hole 622 under the relative effect of the extension tongue 52 being inserted into the groove 623 when the panel structure 50 moves vertically upward or downward within the slot 412.

The cord lock apparatus described above allowing the base 40 to be attachably inserted into the longitudinal opening of the top rail 21. In order to bear the overall weight contributed by the cords 22 and the shade member 23 and the external forces operatively applied by the user when tilting the cords 22, the cord separating member 43 of the base 40 further includes an embedded body 44 so as to lockly engage against the interior of the top rail 21. At least two or a plurality of cords 22 enter into the adjustable portion 41 of the cord lock apparatus 30, then pass through the first-direction ascending opening 411, the slot 412, and the second-direction ascending opening 511 of the panel structure 50, and further pass therebetween through the engaging block 61 and the knurled roller 62. Then, the cords 22 are redirected into another orientation through the guide post 42, and exit the base 40 from the cord separating member 43 and thence eventually enter into the top rail 21, whereby the cords 22 will exit from the top rail 21 to engage with a bottom rail 24 that suspends a plurality of shade member 23.

The guide post 42 is designed as a cord guiding device, which allows the user to operatively adjust the cords in front of the window shade 20 and such action is engaged in a parallel plane with respect to the shade member 23. When the user tilts the cords 22 to the position C, the cords 22 can be relatively adjusted so as to lower or raise the position of the shade member 23 and the bottom rail 24 altogether. When the user releases the cords 22 or relocate the cords to position D, the position of the window shade 23 and the top rail 21 are fixed in place. (Such operation will be described below in details).

In the embodiment of the cord lock apparatus 30 mentioned above, the cord separating member 43 can further include a cord arrangement block 431 along the path of the cords 22. The cord arrangement block 431 has an oblique surface 432 for carrying the cords 22 thereon, and bears the overall weight of the shade member 23, such that the cords 22 will remain separated and they will be prevented from clustering and overlapping one another, assuring that the cords will enter the top rail 21 uniformly and evenly.

In the embodiment of the cord lock apparatus 30 mentioned above, a stopper 433 is further disposed at a front edge of a cord entry end of the cord arrangement block 431 that is, near the sidewall of the cord arrangement block adjacent to the guide post to engage against the interior of the top rail 21 and provide a frictionally interacting effect to one another so as to prevent the cords 22 drop off from the oblique surface 432 when the cords are angularly operated.

In the embodiment of the cord lock apparatus 30, a rotatable moving bush 421 is further included for being sleeved on the guide post 42, such that the cords 22 are passed along more smoothly to achieve an effortless operation and reduce the interacting friction when adjusting the cords 22. One end of the guide post 42 is further covered by an end cap 422 so as to limit and prevent the passing cords 22 leaving from the guide post 42 when repeatedly adjusting the shade member 23 to a desired position.

Moreover, the cord lock apparatus 30 can further include a cover 80 assembled on the base 40. The cover 80 provides a moving space for the cords 22 outside the first-direction ascending opening 411 of the adjustable portion 41. A cave aperture 81 is perpendicularly disposed to the end of the first-direction ascending opening 411, allowing the cords 22 to offset an angle in this direction during operation.

Figure 6A:
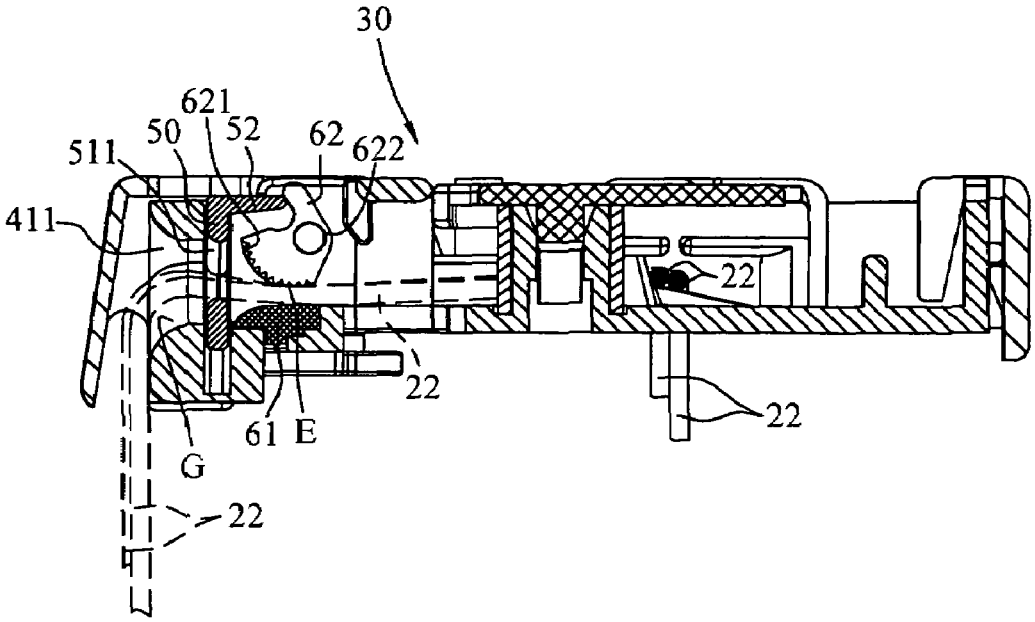
FIG. 6A is a section taken along line I-I of FIG. 5, with the control cords shown in the "release" position in accordance with the present invention.
Figure 6B:
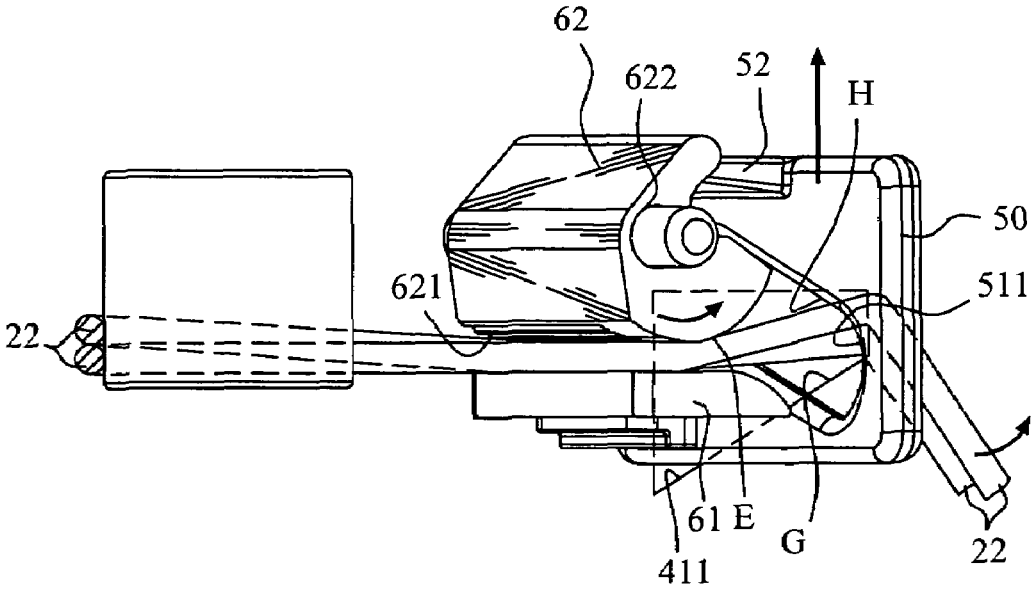
FIG. 6B is an enlarged fragmentary section shown in FIG. 6A.

FIG. 6A is a schematic sectional view taken along I-I of FIG. 5, with the cords shown in the "release" position in accordance with the present invention, and FIG. 6B is an enlarged fragmentary section shown in FIG. 6A. When the cords 22 are drawn to the adjusting position C (as shown in FIG. 4), after contacting a contact surface G of the first-direction ascending opening 411, the cords 22 slide up towards the first direction A (as shown in FIG. 3), and meanwhile, the cords 22 also contact a contact surface H at an upper portion of the second-direction ascending opening 511 to drive the panel structure 50 to move upward. When the panel structure 50 moves upward, the extension tongue 52 interacts with the knurled roller 62 and so that the knurled roller 62 rotates to a release position E and subsequently release the cords of which originally securely locked in place with the engaging block 61 therebetween (as the radius between the axial hole 622 and the notched portion 621 interfering with the cords 22 is substantially reduced). Therefore, the cords 22 can be freely drawn and released at the adjusting position C.

Figure 7A:
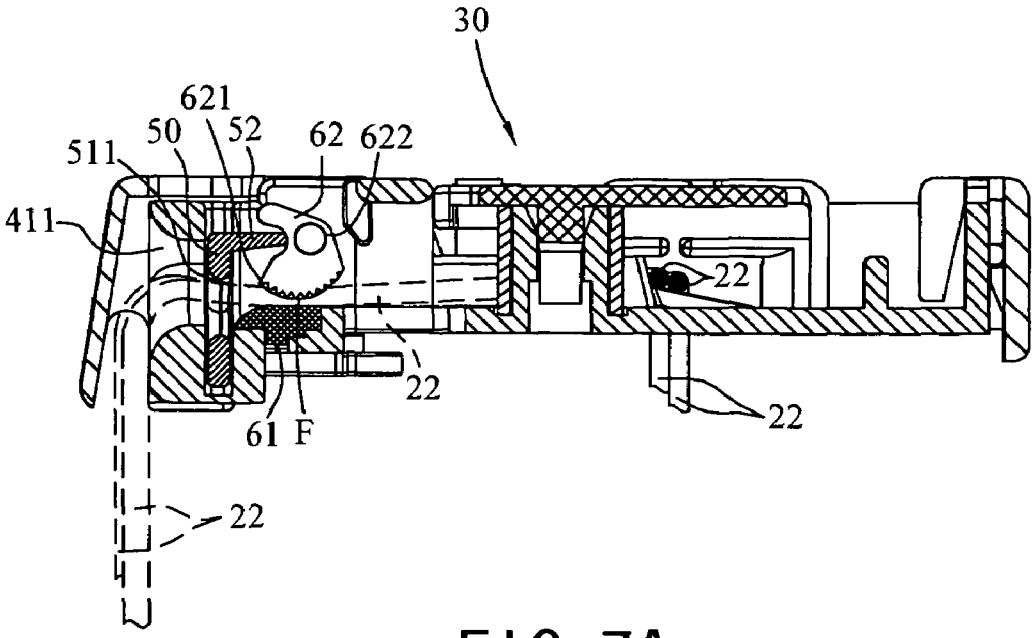
FIG. 7A is a section taken along line I-I of FIG. 5, with the control cords shown in the "lock" position in accordance with the present invention.
Figure 7B:
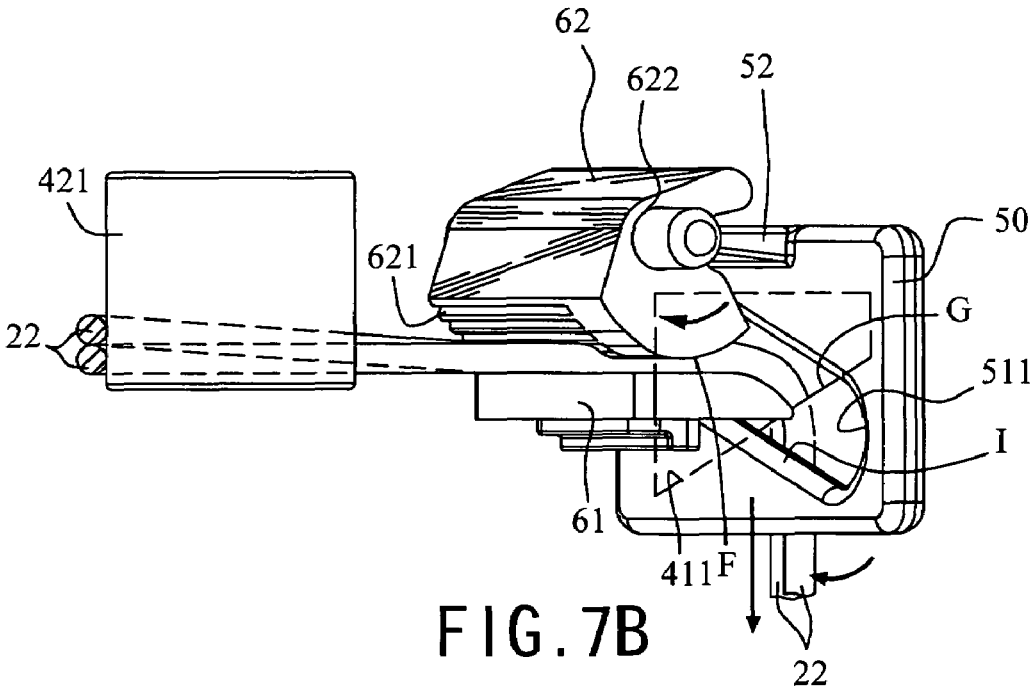
FIG. 7B is an enlarged fragmentary section shown in FIG. 7A.

FIG. 7A is a section taken along line I-I of FIG. 5, with the cords shown in the "lock" position in accordance with the present invention, and FIG. 7B is an enlarged fragmentary section shown in FIG. 7A. When the cords 22 are drawn to the adjusting position D (as shown in FIG. 4), the cords 22 slide to the second direction B (as shown in FIG. 3), and then the force pulling the cords 22 is released (or the pulling force applied on the cords 22 is directly released at the adjusting position C). Such pulling force acting on the cords 22 is generated from the overall weight of the shade member 23 and the bottom rail 24 (as shown in FIG. 4), when the cords 22 pass along the guide post 42 or the rotatable moving bush 421, the pulling force is subsequently transmitted to a contact surface I at a lower portion of the second-direction ascending opening 511. As the inclined contact surface I generates a force to effect the panel structure 50 to move vertically downward, the extension tongue 52 of the panel structure 50 simultaneously moves vertically downward and rotates the engaging block 61 to a locking position F so as to securely lock the cords 22 thereon the engaging block 61 (as the radius between the axial hole 622 and the notched portion 621 interfering with the cords 22 is substantially increased). As a result, the cords 22 are secured at a locking state, and cannot be drawn or released freely.

Figure 8A:
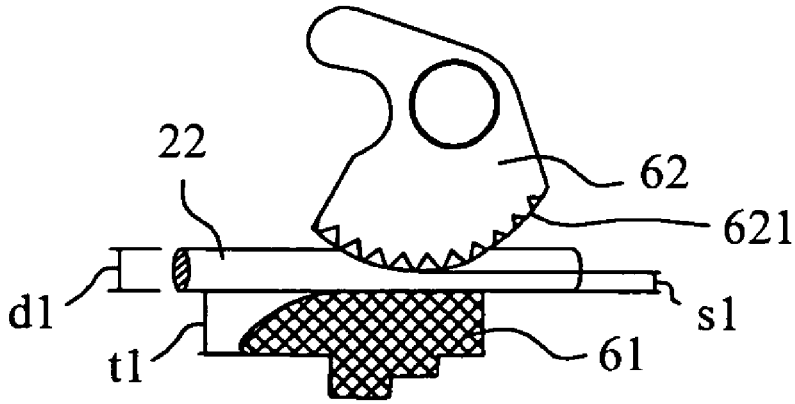
FIGS. 8A and 8B are enlarged schematic views illustrating the engaging cords in varying diameters in accordance with the present invention.
Figure 8B:
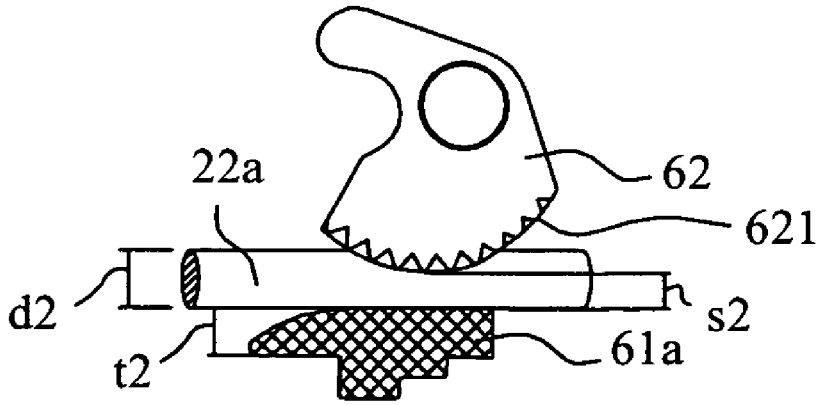

FIGS. 8A and 8B are enlarged schematic views illustrating the engaging cords in varying diameters in accordance with the present invention. A gap s1 is formed between the notched portion 621 and the removably engaging block 61 in thickness t1, allowing the cords to pass through and being applicable for locking the cords 22 having the diameter d1 in place. When the engaging block 61*a* having the less thickness in t2 is rearranged, a substantially increased gap s2 is formed therebetween the engaging block 61*a* and the notched portion 62 comparatively to the original gap s1 so as to allow the cords 22*a* with a relatively increasing diameter d2 in relation to the original diameter d1 of the cords 22 to passing through.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cord lock apparatus housed in a top rail of a window shade, said top rail allowing a plurality of cords to pass through and said cords guided in said top rail of said window shade to exit said rail at an opening of said top rail, said apparatus comprising:

a base, having an adjustable portion, a guide post, and a cord separating member, said guide post is positioned thereon for said cords to laterally pass along, wherein said cord separating member is positioned relative to said adjustable portion such that an angle is formed by said cord separating member and said adjustable portion with respect to said guide post, so as to define a passage for said cords to pass along and enter into said top rail, and said adjustable portion has a first-direction ascending opening and an accommodation recess respectively;

a panel structure, disposed on said adjustable-portion of said base to move in an upward or downward vertical motion, and an insert plate wherein a second-direction ascending opening oriented in an opposite direction from said first-direction ascending opening is disposed thereon allowing said cords to pass through said openings, and an extension tongue is provided extending frontwardly from the upper margin of said insert plate; and a cord gripping device including an engaging block and a knurled roller, said engaging block having an oblique surface at one side and is attached to said accommodation recess, said knurled roller including a notched portion and an axial hole, said knurled roller positioned near the top of said engaging block within said accommodation recess by a shaft passing through said axial hole, and a gap is provided therebetween said knurled roller and said engaging block allowing said cords to pass through;

wherein said panel structure is alternatively adapted to move in a vertically upward or downward motion from operation of said cords, said extension tongue affects said knurled roller to orient to an engaged position when said panel structure is relatively moved in a downward motion wherein the gap between said knurled roller and said engaging block is reduced so as to grip said cords in place, said extension tongue affects said knurled roller to orient to a unlock position when said panel structure is relatively moved in a upward motion wherein the gap between said knurled roller and said engaging block is increased permitting the release action of said cords.

2. The apparatus of claim 1 wherein said cord separating member further includes a cord arrangement block disposed on a cord passing path of said cords, an oblique surface shaped along one side of said cord arrangement block horizontally receiving said cords thereon.

3. The apparatus of claim 2 wherein a stopper is provided near the top of said cord arrangement block adjacent to said guide post so that the stopper can be securely inserted into the interior of said top rail.

4. The apparatus of claim 1 further including a rotatable moving bush sleeved on said guide post, said bush accommodating said cords to pass along.

5. The apparatus of claim 1 wherein said guide post further comprises an end cap.

6. The apparatus of claim 1 wherein said cord separating member of said base further comprises an embedded body so as to be securely inserted into the inner end of said top rail.

7. The apparatus of claim 1 comprising alternative engaging blocks of varying thickness to accommodate the replacement of said engaging block.

8. A window shade comprising:

a cord lock apparatus including a base, a panel structure, and a cord gripping device, wherein said base further includes a cord separating member, a guide post, and an adjustable member, said cord separating member is positioned relative to said adjustable member such that said cord separating member and said adjustable member define an angle with respect to said guide post, said adjustable member including a first-direction ascending opening and an accommodation recess therein; said panel structure has an insert plate wherein a second-direction ascending opening is disposed thereon, and an extension tongue extending frontwardly from the upper margin of said panel structure, said cord griping device further comprises an engaging block and a knurled roller, said engaging block is removably attached within said accommodation recess, said knurled roller further provides a notched portion and an axial hole, said knurled roller positioned within said accommodation recess by a shaft passing through said axial hole and a gap is formed therebetween said knurled roller and said engaging block, whereby said knurled roller is frictionally engaged either to achieve an unlock position or a lock position when said panel structure is moved relatively in a vertically upwardly or downwardly motion;

a top rail allowing said cord lock securely housed therein;

at least one window shade member is suspended beneath said top rail;

a bottom rail disposed beneath said window shade member; and a plurality of cords consecutively passing through said cord lock apparatus, said top rail, said window shade member, and said bottom rail.

* * * * *